United States Patent [19]

Yamashita et al.

[11] 4,451,175

[45] May 29, 1984

[54] METHOD FOR IMPROVING SOFT GROUND BY SAND DRAIN METHOD AND CYLINDRICAL BAG FOR USE IN SAME

[75] Inventors: Hiromichi Yamashita, Tokyo; Yoshiharu Watari, Yokohama; Hideaki Mutsuro, Fukuoka; Kenji Takagi, Funabashi, all of Japan

[73] Assignees: Teijin Limited; Penta-Ocean Construction Co., Ltd., both of Osaka, Japan

[21] Appl. No.: 411,351

[22] Filed: Aug. 25, 1982

[30] Foreign Application Priority Data

| | | | |
|---|---|---|---|
| Feb. 5, 1982 | [JP] | Japan | 57-14068[U] |
| Feb. 5, 1982 | [JP] | Japan | 57-14069[U] |
| Feb. 5, 1982 | [JP] | Japan | 57-14070[U] |
| Feb. 5, 1982 | [JP] | Japan | 57-14071[U] |

[51] Int. Cl.[3] ..... E02B 11/00

[52] U.S. Cl. ..... 405/50; 405/36; 383/1; 383/2; 383/102; 383/107; 383/117; 383/118; 383/120; 229/48 R; 229/48 T

[58] Field of Search ..... 405/50, 36, 37, 43, 405/45; 150/1; 166/117

[56] References Cited

U.S. PATENT DOCUMENTS

| | | | |
|---|---|---|---|
| 2,609,880 | 9/1952 | Dyer | 166/117 |
| 2,788,821 | 4/1957 | Marelle | 150/1 |
| 3,204,760 | 9/1965 | Whiteford | 150/1 |
| 3,396,541 | 8/1968 | Lamberton | 405/50 |
| 3,646,766 | 3/1972 | Hilton et al. | 405/50 |
| 4,239,105 | 12/1980 | Gilbert | 206/568 |

*Primary Examiner*—Dennis L. Taylor

*Attorney, Agent, or Firm*—Burgess, Ryan & Wayne

[57] ABSTRACT

Soft ground is improved by a sand drain method wherein a casing pipe is inserted in the soft ground followed by insertion of a cylindrical bag composed of a water-permeable material into the casing pipe; sand is filled in the cylindrical bag and then only the casing pipe is drawn out from the soft ground whereby a sand drain is constructed in the soft ground; and then, a load is imposed on the sand drain-constructed region to remove water through the sand drain and consolidate the soft ground. The diameter of at least a part of the cylindrical bag is capable of being increased when the consolidation load is imposed on the sand drain-constructed region.

26 Claims, 9 Drawing Figures

METHOD FOR IMPROVING SOFT GROUND BY SAND DRAIN METHOD AND CYLINDRICAL BAG FOR USE IN SAME

BACKGROUND OF THE INVENTION (1) Field of the Invention

The present invention relates to the improvement of soft ground by the sand drain method. More particularly, the present invention relates to a method for improving soft ground composed of a silt soil or clay soil layer by utilizing sand drains contained in water-permeable cylindrical bags, and also to cylindrical bags for use in carrying out this method.

(2) Description of the Prior Art

As a typical conventional technique of improving soft ground composed of, for example, a clay soil of a high water content, there can be mentioned the so-called sand drain method. In this method, sand drains are constructed in the soft ground, and earth or sand is then placed over the soft ground and the sand drains to consolidate the soft ground and remove water through the sand drains. To prevent sand drains from being distorted or split into discontinuous upper and lower portions when constructed in the soft ground, the sand drains are contained in cylindrical bags made of a highly water-permeable, rough-texture sheet composed of a polymeric material or the like.

In conventional sand drain method utilizing the above-mentioned cylindrical bags, a plurality of sand drains are constructed at intervals of about 1 m in soft ground. Each sand drain is contained in a cylindrical bag. When the earth or sand is placed on the sand drain-constructed region to impose the consolidation load thereon, the water contained in the soft ground 1 rises through the sand drains and discharges through a sand mat. This ground concolidates and stabilizes.

Since the sand drains are held in the cylindrical bags, when a consolidation load of earth or sand is imposed on the sand drain-constructed region, the sand draining material is very tightly compacted and consolidated by its own weight. The sand drains in the cylindrical bag therefore act as resisting rigid piles and supports substantially all of the consolidation load. This reduces the consolidation load of earth or sand imposed on the soft ground to an extent insufficient for removing the desired amount of water from the soft ground. Furthermore, even if the soft ground is consolidated to some extent due to the dehydration, the sand drain acting as a resisting rigid pile is not deformed and yields negative friction to the soft ground and, thus, the settlement of the soft ground is only to a minor extent.

SUMMARY OF THE INVENTION

It is a primary object of the present invention to provide a sand drain method in which the above-mentioned defects of the conventional drain method are eliminated, that is, a sand drain method in which when a consolidation load is imposed on a sand drain-constructed region, sand drains are readily deformed and do not support this load, whereby a high consolidation effect can be attained.

Another object of the present invention is to provide a cylindrical bag for use in carrying out the above-mentioned sand drain method.

More specifically, in accordance with one aspect of the present invention, there is provided a sand drain method for improving soft ground, which comprises the steps of: (a) inserting a casing pipe into the soft ground and inserting a cylindrical bag composed of a water-permeable material into the casing pipe, (b) constructing a sand drain by filling sand in the inserted cylindrical bag followed by drawing out the casing pipe and leaving the sand-filled cylindrical bag in the soft ground, and (c) imposing a load on the sand drain-constructed region to remove water through the sand drain and consolidate the soft ground, characterized by using a cylindrical bag with a diameter at least a part of which is capable of being increased when the load is imposed on the sand drain-constructed region.

In accordance with another aspect of the present invention, there is provided a cylindrical bag for the sand drain method, which is used for construction of a sand drain by filling sand therein and is composed of a water-permeable material, said cylindrical bag being characterized in that when a consolidation load is imposed on a sand drain-constructed region, the diameter of at least a part of the cylindrical bag is increased.

DETAILED DESCRIPTION OF THE PREFERRED EMBODIMENTS

The sand drain method of the present invention and the cylindrical bag to be used for this sand drain method will now be described in detail with reference to the accompanying drawings.

Figure 1:
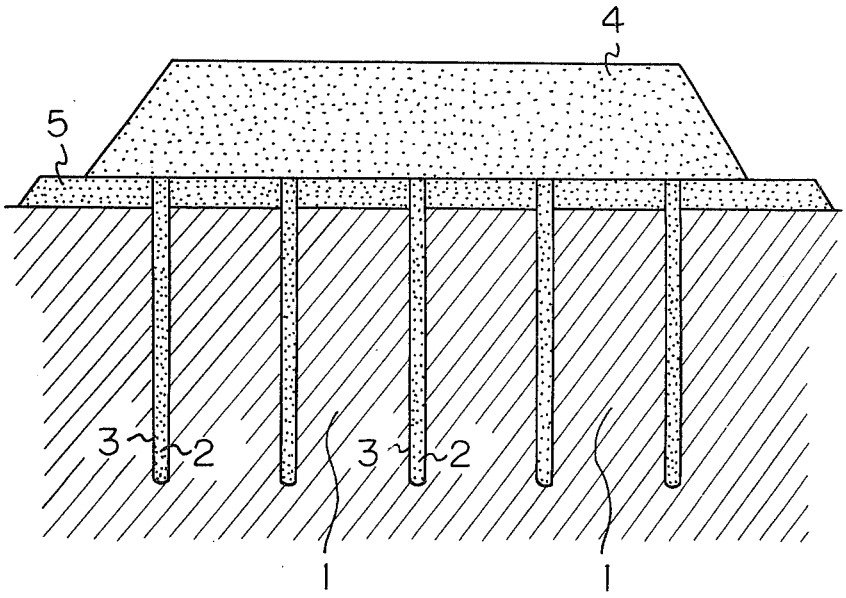
FIG. 1 is a sectional view of a ground, which is given for illustration of the sand drain method utilizing a cylindrical bag.

A great number of casing pipes are inserted at predetermined intervals of, for example, 1 m in a soft ground to be improved. A cylindrical bag is inserted into each casing pipe. Then, sand is filled in the cylindrical bags and the casing pipes are drawn out, leaving the sand-filled cylindrical bags in the soft ground whereby a great number of sand drains are constructed. Earth or sand is placed on the sand drain-constructed region creating a consolidation load removing the water from the soft ground through the sand drains. FIG. 1 illustrates the state where a plurality of sand drains are constructed in a soft ground 1 and earth or sand 4 is placed on the sand drain-constructed region to impose a consolidation load. Each sand drain comprises a cylindrical bag 3 composed of a material having a good water permeability, such as a woven or knitted fabric having a rough texture, and sand 2 filled in the bag 3. Placement of earth or sand 4 on the sand drain-constructed region impose a consolidation load, as shown in FIG. 1, the pressure of water present in the pores in the soft ground is increased whereby water is squeezed from the soft ground 1 and caused to rise through the sand drains, and water is discharged through a sand mat layer 5.

The cylindrical bag 3 used in the present invention is characterized in that imposition of a consolidation load is imposed on the sand drain-constructed region increases the diameter of at least a part of the cylindrical bag 3. Accordingly, application of the consolidation load both causes the water present in the pores in the soft ground to flow out through the sand drains and the sand mat layer 5 and, simultaneously, causes the soft ground to gradually consolidate and the diameter of the cylindrical bag 3 to increase. Namely, the consolidation of the soft ground is accompanied by an increase in the diameter of each sand drain, i.e., the deformation of the sand drain is not restricted. Thus, the sand in each sand drain is not tightly compacted. Namely, the sand drain does not act as a rigid pile and does not support the substantial part of the consolidation load. As a result, free settlement of the soft ground is not prevented.

Ordinarily, the cylindrical bags 3 are formed by cutting a long cylindrical material into an appropriate size and closing one end of each bag at the sand drain-constructing step. Each cylindrical bag is then inserted into the casing pipe previously inserted in the soft ground. The cylindrical bag ordinarily has a length of 3 to 40 m, for example, about 20 m and has a diameter of 10 to 60 cm, for example, about 12 cm, at the sand drain-constructing step. When the consolidation load is applied, the diameter of the cylindrical bag ordinarily is increased 10% to 30% based on the diameter at the sand-drain constructing step.

As the water-permeable material constituting the cylindrical bag, there is used a knitted or woven fabric of, for example, a fiber or a split yarn. Several examples of the cylindrical bag of the present invention, the diameter of which is increased at the step of imposing a consolidation load, are illustrated in FIGS. 2 through 8.

A cylindrical bag 3 according to the first embodiment of the present invention is characterized in that it has at least two bound portions, that is, the bound portion defining the minimum diameter of the cylindrical bag having the lowest bonding strength and the bound portion defining the maximum diameter thereof having the highest bonding strength. Each of the cylindrical bags 3 shown in FIGS. 2, 3 and 4 has two bound portions, that is, a first bound portion 6 defining the minimum diameter and a second bound portion 7 defining the maximum diameter. Reference numeral 8 in FIG. 3 represents a tuck.

Any known methods may be adopted for formation of bound portions. For example, bound portions may be formed by sewing with a thread as illustrated in FIG. 2, adhesive bonding or fusion bonding as illustrated in FIG. 3, or knitting or weaving as illustrated in FIG. 4.

Figure 2:
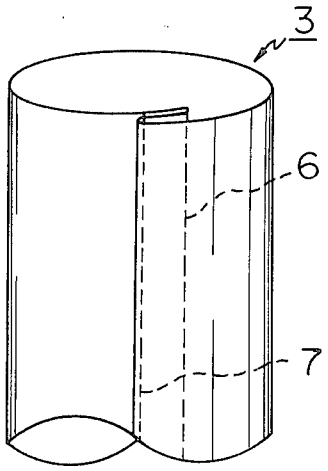
FIGS. 2, 3 and 4 are perspective views showing examples of the cylindrical bag to be used in the present invention, which have a plurality of bound portions with different binding strengths.
Figure 3:
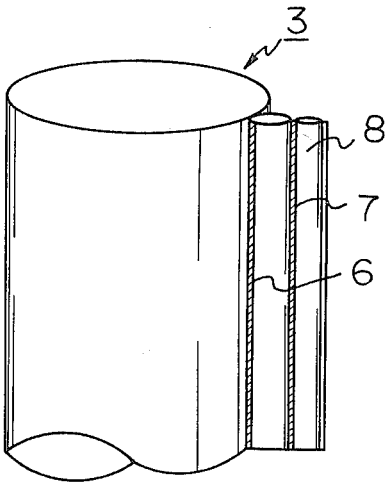
Figure 4:
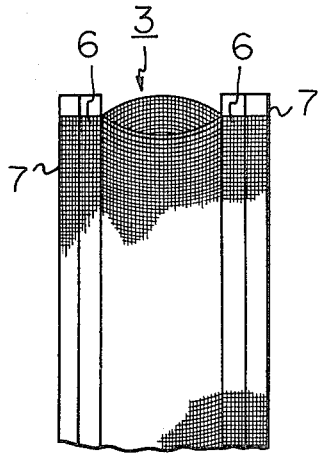

The bound portions 6 and 7 may be separate from each other as illustrated in FIGS. 2 and 3. Alternatively, the bound portions 6 and 7 are adjacent to each other as illustrated in FIG. 4.

The bindings of the bound portions other than that defining the maximum diameter should have a low enough breaking strength to separate when a consolidation load is applied to the sand drain. If the binding of the bound portion defining the maximum diameter breaks on application of the consolidation load, as in case of the conventional sand drain, and the sand drain is constricted or split. Accordingly, it is indispensable that the bound portion defining the maximum diameter should have a high strength. It is preferred that said bound portion have a strength as high as that of the fibers-constituting the bags. When one or more bound portions are interposed between the bound portion defining the minimum diameter and the bound portion defining the maximum diameter, it is preferred that the bonding strengths be successively higher from the bound portion defining the minimum diameter to the bound portion defining the maximum diameter so that when the consolidation load is applied, these bound they break one by one.

The bound portion having a low strength is formed by sewing with a water-soluble thread such as a thread of polyvinyl alcohol fibers or with a thread with a bonding strength reduced by the action of water, or is formed by bonding with a water-soluble adhesive such as a cellulose type or urea resin type or with an adhesive with a bonding strength reduced by the action of water.

Figure 5:
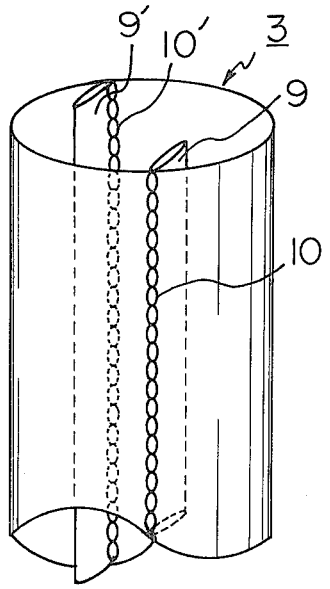
FIGS. 5 and 6 are perspective views showing other examples of the cylindrical bag to be used in the present invention, which have at least one tuck.
Figure 6:
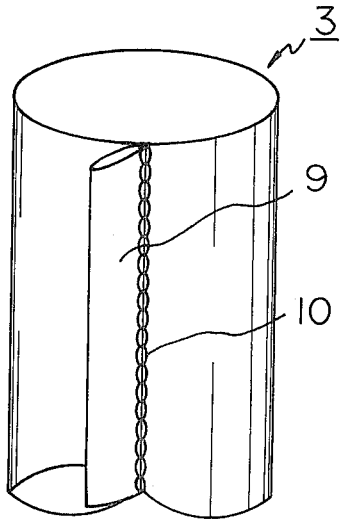
Figure 7:
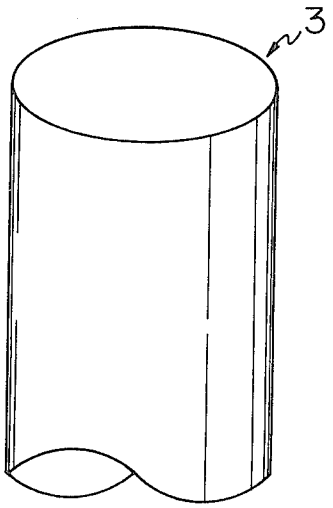
FIG. 7 is a perspective view showing still another example of the cylindrical bag to be used in the present invention, which is composed of an elastic fabric.

A cylindrical bag 3 according to the second embodiment of the present invention is illustrated in FIGS. 5 and 6 This cylindrical bag 3 is characterized in that it has one or more tucks 9 and 9' extending in the longitudinal direction thereof and in that the bonding force for formation of these tucks is lower than the breaking strength of the fibers constituting the cylindrical bag 3. One tuck 9 may be formed on the cylindrical bag 3 as shown in FIG. 6, or two tucks 9 and 9' may be formed on the cylindrical bag 3 as shown in FIG. 5. Furthermore, at least three tucks may be formed in the cylindrical bag, though not shown in the drawings. The tuck may be formed on the inner side of the cylindrical bag 3 as shown in FIG. 5 or on the outer side of the cylindrical bag 3 as shown in FIG. 6.

Any known methods may e adopted for formation of tucks. For example, a tuck may be formed by sewing, adhesive bonding or fusion bonding. However, the bonding strength of the bound portion for formation of a tuck should be lower than the pressure of the load for consolidation. When at least two tucks are formed, the bonding strengths for these tucks may be the same or different. In order to gradually expand and open the tuck, the bonding strengths of the tucks may be changed stepwise. This can also be accomplished by forming at least two bound portions in one tuck and changing the bonding strengths of these bound portions from one another so that the tuck is expanded and opened stepwise. When the tuck is formed by sewing, a thread of fibers with a breaking strength reduced by the action of water may be used as the tuck-forming stitch thread. For example, there may be used threads of fibers having a dry breaking strength higher than the wet breaking strength or threads of water-soluble fibers such as polyvinyl alcohol fibers. When a tuck is formed by using an adhesive with a bonding strength reduced by the action of water, the above-mentioned effect can similarly be attained.

A cylindrical bag according to the third embodiment of the present invention is composed of an elastic fabric. By the term "elastic fabric" is meant a woven or knitted fabric having elastic characteristics.

It is sufficient if the cylindrical bag of the third embodiment is formed of an elastic fabric. Ordinarily, it need possess no bound portion as the cylindrical bags of the above-mentioned first and second embodiments or the cylindrical bag of the fourth embodiment described hereinafter, as is seen from FIG. 7. However, a bound portion as formed in other embodiments may be formed when the elasticity of the elastic fabric is low.

The elastic fabric may be prepared by knitting or weaving fibers inherently having elasticity, such as polyurethane fibers or fibers of a polybutylene terephthalate/polyethylene terephthalate copolymer composed mainly of butylene terephthalate units or by knitting or weaving fibers which are inherently non-elastic but have been rendered elastic by a crimping treatment or the like. Furthermore, a fabric having an elastic texture, such as a warp double pile weave fabric, a weft double pile weave fabric, a rib knit fabric or an interlock knit fabric may be used as the elastic fabric. Moreover, a fabric formed by using polyurethane-polyamide copolymer fibers, side-by-side conjugate fibers or polyester fibers covered with polyurethane fibers may be used. The above-mentioned elastic material, elastic treatment and elastic texture may be adopted appropriately in combination to obtain an elastic fabric.

If an elastic fabric such as mentioned above is used for formation of a sand drain bag, application of a consolidation load increases the diameter of the bag is increased accordingly.

According to the fourth embodiment of the present invention, the cylindrical bag has at least two seam portions. The stitch threads of the seam portions other than the seam portion defining the maximum diameter of the cylindrical bag are extractable.

Figure 8:
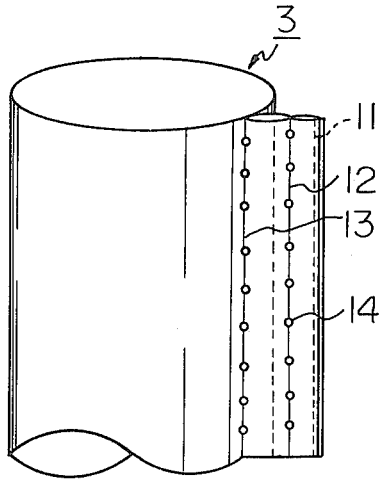
FIGS. 8 and 9 are perspective views showing further examples of the cylindrical bag to be used in the present invention, which have a stitch-extractable seam.
Figure 9:
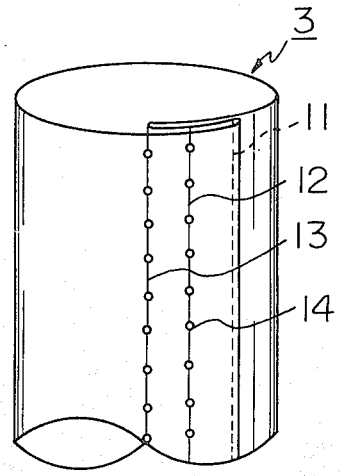

Each of the cylindrical bags 3 shown in FIGS. 8 and 9 has three seam portions. Namely, each of the cylindrical bags 3 shown in FIGS. 8 and 9 has a seam portion defining the minimum diameter, which is formed by a stitch thread 13, a seam portion defining the medium diameter, which is formed by a stitch thread 12 and a seam portion defining the maximum diameter, which is formed by a stitch thread 11. Many rings 14 having a small diameter are attached to the seam portions formed by the stitch threads 13 and 12 so that the stitch threads 13 and 12 can easily be extracted.

When the above-mentioned cylindrical bag is used for formation of a sand drain and a consolidation load is imposed on a sand drain-constructed region, the stitch threads can be extracted in sequence, whereby the diameter of the cylindrical bag is increased, i.e., the bag is expanded. Accordingly, the pressure for consolidation can effectively be exerted in the soft ground without any restraint. Incidentally, since a large force is necessary for extraction of the stitch threads, it is necessary to use stitch threads having a strength sufficient to resist this large extracting force.

I claim:

1. A sand drain method for improving soft ground having an undesirably high water content by imposing a load on the surface of said ground to cause removal of water via at least one sand drain, which comprises the steps of:

inserting a casing pipe into the soft ground followed by insertion of a cylindrical bag composed of a water-permeable material into the casing pipe, at least a part of said bag including means responsive to imposition of said load for increasing the diameter of said bag part;

constructing a sand drain by filling sand in the inserted cylindrical bag followed by drawing out the casing pipe, leaving the sand-filled cylindrical bag in the soft ground; and imposing a load on the surface of the soft ground adjacent said sand drain to remove water through the sand drain and consolidate the soft ground, whereby the diameter of said bag part increases so that the sand drain does not act as a rigid pile and does not support a substantial part of the consolidation load, thus allowing free settlement of the soft ground.

2. A sand drain method according to claim 1 comprising the step of forming on the cylindrical bag at least two bound portions of different bonding strengths extending in parallel and in the longitudinal direction of the cylindrical bag, a bound portion having the lowest bonding strength defining a minimum diameter of the cylindrical bag and the bound portion having the highest bonding strength defining a maximum diameter thereof.

3. A sand drain method according to claim 1, comprising the additional step of forming on the cylindrical bag at least one tuck extending in the longitudinal direction of the cylindrical bag and the tuck has a bonding force lower than the strength of a material comprising the cylindrical bag.

4. A sand drain method according to claim 1, comprising the step of forming the cylindrical bag of an elastic fabric.

5. A sand drain method according to claim 1, comprising the step of forming on the cylindrical bag at least two seam portions by sewing with stitch threads, the stitch threads of the seam portions other than the seam portion defining a maximum diameter of the cylindrical bag are extractable.

6. A cylindrical bag adapted for improving soft ground having an undesirably high water content by the sand drain method, which is used for construction of a sand drain by filling sand therein in situ and which is composed of a water-permeable material, at least a part of said bag including means reponsive to imposition of a load on the surface of soft ground surrounding the bag, for increasing the diameter of said bag part.

7. A cylindrical bag as set forth in claim 6, wherein the water-permeable material comprises a fabric.

8. A cylindrical bag as set forth in claim 6, wherein the cylindrical bag has a length of 3 to 40 meters and a diameter of 10 to 60 centimeters.

9. A cylindrical bag as set forth in claim 6, wherein the cylindrical bag has formed thereon at least two bound portions of different bonding strengths extending in parallel and in the longitudinal direction of the cylindrical bag, the bound portion having the lowest bonding strength defining a minimum diameter of the cylindrical bag and the bound portion having the highest bonding strength defining a maximum diameter thereof.

10. A cylindrical bag as set forth in claim 9, wherein the bound portion defining the maximum diameter thereof has a bonding strength approximately the same as the strength of the material comprising the cylindrical bag.

11. A cylindrical bag as set forth in claim 9, wherein the cylindrical bag has formed thereon at least three bound portions extending in parallel and in the longitudinal direction of the cylindrical bag and the bound portions have bonding strengths such that when a consolidation load is imposed on the sand drain-constructed region, the bound portions are broken in sequence from the bound portion defining the minimum diameter toward the bound portion defining the maximum diameter of the bag.

12. A cylindrical bag as set forth in any one of claims 9 through 11, wherein the bound portions other than the bound portion defining the maximum diameter of the cylindrical bag are formed by sewing the bag with water-soluble fibers or fibers with a bonding strength reduced by the action of water.

13. A cylindrical bag as set forth in any one of claims 9 through 11, wherein the bound portions other than the bound portion defining the maximum diameter of the cylindrical bag are formed by bonding the bag with a water-soluble adhesive or an adhesive with a bonding strength reduced by the action of water.

14. A cylindrical bag as set forth in any one of claims 6 through 11, wherein the bound portions are formed by weaving.

15. A cylindrical bag as set forth in claim 6, wherein the cylindrical bag has formed thereon at least one tuck xtending in the longitudinal direction of the cylindrical bag and the tuck has a bonding force lower than the breaking strength of the material comprising the cylindrical bag.

16. A cylindrical bag as set forth in claim 15, wherein the tuck is formed by sewing the bag with a sewing thread.

17. A cylindrical bag as set forth in claim 15 or 16, wherein the tuck-forming sewing thread comprises water-soluble fibers or fibers with a breaking strength reduced by the action of water.

18. A cylindrical bag as set forth in claim 15, wherein the tuck is formed by adhesion of adjacent portions of the bag.

19. A cylindrical bag as set forth in claim 18, wherein the adhesive used for formation of the tuck is a water-soluble adhesive or an adhesive with a bonding force reduced by the action of water.

20. A cylindrical bag as set forth in claim 6 comprising an elastic fabric.

21. A cylindrical bag as set forth in claim 7, wherein the fabric comprises an elastic yarn.

22. A cylindrical bag as set forth in claim 21, wherein the elastic yarn is comprised of polybutylene terephthalate fibers.

23. A cylindrical bag as set forth in claim 20, wherein the fabric has an elastic texture.

24. A cylindrical bag as set forth in claim 6, wherein the cylindrical bag has at least two seam portions formed thereon by sewing with stitch threads, and the stitch threads of seam portions other than the seam portion defining a maximum diameter of the cylindrical bag are extractable.

25. A cylindrical bag as set forth in claim 24, wherein the cylindrical bag has a tuck extending in the longitudinal direction thereof on which at least two seam portions are formed.

26. A cylindrical bag as set forth in any one of claims 6 through 11, 15, 16, or 18, 25 wherein the bound portions are formed by knitting.

* * * * *